US010240293B2

(12) United States Patent
Ogiwara

(10) Patent No.: US 10,240,293 B2
(45) Date of Patent: Mar. 26, 2019

(54) PAPERMAKING FELT

(71) Applicant: Ichikawa Co., Ltd, Bunkyo-ku (JP)

(72) Inventor: Yasuyuki Ogiwara, Bunkyo-ku (JP)

(73) Assignee: Ichikawa Co., Ltd., Bunkyo-ku (JP)

( * ) Notice: Subject to any disclaimer, the term of this patent is extended or adjusted under 35 U.S.C. 154(b) by 42 days.

(21) Appl. No.: 15/492,088

(22) Filed: Apr. 20, 2017

(65) Prior Publication Data

US 2017/0306560 A1 Oct. 26, 2017

(30) Foreign Application Priority Data

Apr. 21, 2016 (JP) ..... 2016-096481
Mar. 22, 2017 (JP) ..... 2017-056503

(51) Int. Cl.
*D21F 1/00* (2006.01)
*D21F 7/08* (2006.01)

(52) U.S. Cl.
CPC ..... *D21F 7/083* (2013.01); *D21F 1/0081* (2013.01)

(58) Field of Classification Search
USPC ..... 162/289
See application file for complete search history.

(56) References Cited

U.S. PATENT DOCUMENTS 5,360,656 A 11/1994 Rexfelt et al.
5,713,399 A 2/1998 Collette et al.
5,785,818 A 7/1998 Fekete et al.
5,916,421 A 6/1999 Yook
5,939,176 A 8/1999 Yook
6,117,274 A 9/2000 Yook
6,162,518 A 12/2000 Korfer
6,240,608 B1 6/2001 Paquin et al.
6,265,048 B1 7/2001 Rydin et al.
6,350,336 B1 2/2002 Paquin
6,565,713 B2 5/2003 Hansen et al.
(Continued)

FOREIGN PATENT DOCUMENTS

EP 1 067 238 A2 1/2001
EP 1 378 602 A1 1/2004
(Continued)

OTHER PUBLICATIONS

Extended European Search Report dated Aug. 14, 2017 in Patent Application No. 17166503.7.

*Primary Examiner* — Mark Halpern
(74) *Attorney, Agent, or Firm* — Oblon, McClelland, Maier & Neustadt, L.L.P.

(57) ABSTRACT

There is provided a papermaking felt comprising at least one base fabric and at least one batt layer integrated with the base fabric. The base fabric comprises a first base fabric, a second base fabric, and a third base fabric, the first base fabric, the second base fabric, and the third base fabric are laminated together in an arbitrary order, the first base fabric is a base fabric formed by spirally winding, in a right-handed manner, a band-shaped body having a width smaller than a width of the papermaking felt, the second base fabric is a base fabric formed by spirally winding, in a left-handed manner, a band-shaped body having a width smaller than the width of the papermaking felt, and the third base fabric is a base fabric having at least a plurality of ground warp yarns parallel to an machine direction of the papermaking felt.

19 Claims, 3 Drawing Sheets

(56) References Cited

U.S. PATENT DOCUMENTS

| | | | | |
|---|---|---|---|---|
| 6,723,208 | B1 | 4/2004 | Hansen | |
| 6,776,878 | B2 | 8/2004 | Yook | |
| 7,101,599 | B2 | 9/2006 | Moriarty | |
| 2004/0026058 | A1 | 2/2004 | Watanabe et al. | |
| 2017/0022666 | A1* | 1/2017 | Ogiwara | B29C 53/56 |
| 2017/0030019 | A1* | 2/2017 | Ogiwara | B29C 53/56 |

FOREIGN PATENT DOCUMENTS

| | | |
|---|---|---|
| JP | 6-503385 | 4/1994 |
| JP | 10-226978 | 8/1998 |
| JP | 10-513511 | 12/1998 |
| JP | 2000-27089 | 1/2000 |
| JP | 2000-80584 | 3/2000 |
| JP | 2000-80585 | 3/2000 |
| JP | 2000-80586 | 3/2000 |
| JP | 2000-509772 | 8/2000 |
| JP | 2000-303378 | 10/2000 |
| JP | 2001-3290 | 1/2001 |
| JP | 2001-40594 | 2/2001 |
| JP | 2004-510896 | 4/2004 |
| JP | 2004-526877 | 9/2004 |
| JP | 2005-521807 | 7/2005 |
| JP | 2006-504873 | 2/2006 |

* cited by examiner

PAPERMAKING FELT

CROSS REFERENCE TO RELATED APPLICATIONS

This application is based upon and claims benefit of priority from Japanese Patent Application No. 2016-096481, filed on Apr. 21, 2016, and Japanese Patent Application No. 2017-056503, filed on Mar. 22, 2017, the entire contents of which are incorporated herein by reference.

BACKGROUND

The present invention relates to a papermaking felt used for a papermaking machine (hereinafter also referred to as simply a "felt").

A papermaking machine that removes water from the source material of paper generally comprises a wire part, a press part, and a drier part. The wire part, the press part, and the drier part are arranged in this order along the wet paper web conveyance direction. The wet paper web moves through the papermaking machine in a band shape, with a certain width in the direction (the cross-machine direction, CMD) perpendicular to the direction of running of the papermaking machine (the machine direction, MD), and is conveyed to be squeezed to remove water and finally dried in the drier part while being sequentially passed through the papermaking equipment provided in the wire part, the press part, and the drier part.

The press part comprises a plurality of press apparatuses that are provided side by side in series along the wet paper web conveyance direction. Each press apparatus comprises an endless felt or a felt in which ends of an ended felt are connected on the papermaking machine into an endless shape, and a pair of rolls (i.e., a roll press), which are arranged facing each other in the vertical direction to sandwich a part of the felt, or a cylindrical belt comprising a roll and a shoe (i.e., a shoe press), and uses the felt together with the rolls or the cylindrical belt including a roll and a shoe to press and apply pressure to the wet paper web conveyed by the felt running at a substantially constant speed in the fixed direction and thus dehydrates the wet paper web continuously.

Water squeezing capability, smoothness, running stability, etc. are required as functions for the felt used for the press apparatus. The water squeezing capability refers to the capability to remove water contained in the wet paper web. To achieve this function, it is important that the felt have a good compression recovery property, that is, when the felt is not under pressure, a space (void volume) for removing the water of the felt exist in the felt, and when the felt is under pressure, the density of the felt be maximized and the volume of the space be reduced to discharge the water to the outside of the felt. It is also important that the water squeezing capability be maintained during a period of use of the felt and that the removed water not return to the wet paper web (re-wetting prevention).

The smoothness refers to the smoothness of the surface of the wet paper web and the surface of the felt (including the surface of the felt under pressure). Since the wet paper web is pressed via the felt, the surface condition of the felt is transferred to the surface of the wet paper web. Hence, to smooth the surface of the wet paper web, it is necessary to smooth the surface of the felt (including the surface of the felt under pressure).

The running stability refers to the capability of the endless felt placed in the press apparatus to run stably without the occurrence of deviation, meandering, vibration, waving, etc.

There are various kinds of paper, such as paper for newspapers, high-quality paper, paperboards, and household paper, and there are also various kinds of papermaking machines that produce these kinds of paper. Various kinds of papermaking felt are currently produced to fit these kinds of paper and papermaking machines; in general, the felt is formed by integrating a batt layer of a nonwoven fiber material with a base fabric. The base fabric may be, for example, a woven fabric formed of monofilament yarns, monofilament twisted yarns, multifilament yarns, or multifilament twisted yarns, and the woven fabric may be a single-woven article or a multiple-woven article, or may be a laminated structure in which these are laminated together. The yarn can be usually made of a material produced by extrusion-molding a synthetic polymer resin that a person skilled in the technical field of papermaking equipment uses for this objective, such as a polyamide resin or a polyester resin, or animal fibers such as wool or vegetable fibers such as cotton or hemp.

As the base fabric mentioned above, there are various kinds of woven fabric, such as one in which weaving is performed on a weaving machine to obtain an endless shape (hollow weaving), one in which ends of an ended woven fabric obtained by plain weaving are sewn together into an endless shape, and one in which seam loops are formed at each of the two ends in the cross-machine direction of an ended woven fabric, the seam loops at both ends are engaged with each other on a papermaking machine, and a core line is inserted into their common holes to form an endless shape.

In any case, the base fabric has an endless form or is configured to allow its ends to be joined together into an endless form, and the length dimension and the width dimension of the base fabric (felt) are dimensions corresponding to each papermaking machine. Since the papermaking machines have various dimensions, the base fabric (felt) of the felt is produced completely in a made-to-order manner as a matter of course.

In the case where base fabrics matched with various dimensions are woven with a weaving machine, the productivity is very poor and the yield is poor. In order to produce these base fabrics more efficiently, a method in which a band-shaped body with a width smaller than the width dimension of the papermaking felt is spirally wound, the side edges of the band-shaped body are joined together, and the base fabric formed is used as the base fabric of the papermaking felt is proposed (e.g. JP H06-503385T, JP H10-226978A, JP 2000-027089A, JP 2000-303378A, JP 2001-040594A, JP 2004-510896T, JP 2004-526877T, and JP 2006-504873T). Further, a method in which a band-shaped body narrower than the width dimension of the papermaking felt is spirally wound, the side edges of the band-shaped body are joined together, the base fabric formed is folded, and a seam loop is formed at the fold (e.g. JP H10-513511T, JP 2000-080585A, JP 2000-080586A, and JP 2005-521807T), and a method in which a band-shaped body narrower than the width dimension of the papermaking felt is spirally wound, the side edges of the band-shaped body are joined together, and the formed base fabric and an endless base fabric are laminated together (e.g. JP 2000-509772T, JP 2000-080584A, and JP 2001-003290A) are proposed.

SUMMARY

The band-shaped body used for a base fabric of a papermaking felt disclosed in the prior art literatures mentioned above can significantly reduce the production cost from the viewpoint that there is no need to prepare a large-sized weaving machine and thereby the yield is improved and the viewpoint that the band-shaped body can be stored regardless of the dimensions of the papermaking felt. The band-shaped body is particularly efficient in a configuration in which a plurality of layers of base fabric using the band-shaped body are laminated together. However, since the weft direction of the band-shaped body and the width direction of the base fabric (CMD) do not coincide, providing a seam loop to the base fabric formed by spirally winding the band-shaped body has a very high degree of difficulty in production, and increases the production cost because of the need for a larger time of seam loop formation.

Furthermore, it is feared that the base fabric (felt) formed by spirally winding the band-shaped body will be wrinkled during production or use. In general, the base fabric (felt) is produced by putting the base fabric on at least two parallel arranged rolls and continuously applying tension. Here, in the base fabric formed by spirally winding the band-shaped body, the warp direction of the band-shaped body and the direction of running of the base fabric (MD) are different, and the warp direction of the band-shaped body has a certain inclination with respect to the direction of running of the base fabric. When tension is applied to the base fabric, a force that tends to be parallel to the minimum distance between rolls, that is, the direction of running of the base fabric (MD) acts on the warp yarn of the band-shaped body, and consequently the base fabric may be wrinkled. The problem of wrinkling may occur also at the time of producing a felt in which batt fibers are entangled and integrated with the base fabric and at the time of using the completed felt in a papermaking machine, like during the production of the base fabric.

In the case where a fabric using three layers of base fabric each formed by spirally winding a band-shaped body having a width smaller than the width dimension of a papermaking felt and joining the side edges of the band-shaped body is used as a base fabric of the papermaking felt, the winding manner is either the case where the band-shaped bodies of all the three layers of base fabric have the same winding direction or the case where two layers are wound right-handed (left-handed) and one layer is wound left-handed (right-handed). In this case, the balance of winding direction as the entire base fabric is not good, and deviation may occur during the production or use of the felt.

The present invention provides a base fabric of a papermaking felt and a papermaking felt in which, even when a base fabric formed by spirally winding a band-shaped body having a width smaller than the width of a papermaking felt is used, wrinkling and deviation do not occur during the production of the base fabric or the felt or during the use of the felt.

The present invention can solve the problem mentioned above by forming a base fabric of a papermaking felt by laminating together and arranging, in an arbitrary order, two base fabrics with different winding directions each of which is formed by spirally winding a band-shaped body having a width smaller than the width of the papermaking felt and at least one base fabric that comprises a plurality of ground warp yarns parallel to the MD direction of the papermaking felt; and specifically uses the following technology.

(1) A papermaking felt comprising at least one base fabric and at least one batt layer integrated with the base fabric, wherein the base fabric comprises a first base fabric, a second base fabric, and a third base fabric, the first base fabric, the second base fabric, and the third base fabric are laminated together in an arbitrary order, the first base fabric is a base fabric formed by spirally winding, in a right-handed manner, a band-shaped body having a width smaller than a width of the papermaking felt and having a plurality of ground warp yarns, a plurality of ground weft yarns, a first side edge parallel to a ground warp direction, and a second side edge parallel to the ground warp direction in such a manner that the first side edge and the second side edge are adjacent and thereby joining the side edges together, the second base fabric is a base fabric formed by spirally winding, in a left-handed manner, a band-shaped body having a width smaller than the width of the papermaking felt and having a plurality of ground warp yarns, a plurality of ground weft yarns, a first side edge parallel to a ground warp direction, and a second side edge parallel to the ground warp direction in such a manner that the first side edge and the second side edge are adjacent and thereby joining the side edges together, the third base fabric is a base fabric having at least a plurality of ground warp yarns parallel to an machine direction of the papermaking felt.

(2) The papermaking felt according to (1), wherein strength in a warp direction of the third base fabric is 10% or more of strength in a warp direction of the first base fabric or a strength in a warp direction of the second base fabric.

(3) The papermaking felt according to (1) or (2), wherein strength in the warp direction of the third base fabric is 50% or more of strength in the warp direction of the first base fabric or the strength in the warp direction of the second base fabric.

(4) The papermaking felt according to any one of (1) to (3), wherein strength in the warp direction of the third base fabric is 100% or more of strength in the warp direction of the first base fabric or the strength in the warp direction of the second base fabric.

(5) The papermaking felt according to any one of (1) to (4), wherein width dimensions of the band-shaped body of the first base fabric and the band-shaped body of the second base fabric are 50 cm to 150 cm.

(6) The papermaking felt according to any one of (1) to (5), wherein width dimensions of the band-shaped body of the first base fabric and the band-shaped body of the second base fabric are the same.

(7) The papermaking felt according to any one of (1) to (6), wherein the band-shaped body of the first base fabric and the band-shaped body of the second base fabric are of the same material.

(8) The papermaking felt according to any one of (1) to (7), wherein the band-shaped body of the first base fabric and the band-shaped body of the second base fabric are the same woven fabric.

(9) The papermaking felt according to any one of (1) to (8), wherein the third base fabric is a base fabric formed by arranging, in a cross-machine direction, N or more ($N \geq 2$) annular band-shaped bodies, each of which is obtained by joining together end edges of a band-shaped body having a width smaller than the width of the papermaking felt and having a plurality of ground warp yarns, a plurality of ground weft yarns, a first end edge parallel to a ground weft direction, a second end edge parallel to the ground weft direction, a first side edge parallel to a ground warp direction, and a second side edge parallel to the ground warp direction, in such a manner that the first end edge and the second end edge are adjacent, and joining together the second side edge of an N−1-th annular band-shaped body and the first side edge of an N-th annular band-shaped body in such a manner that both side edges are adjacent.

(10) The papermaking felt according to (9), wherein a width dimension of the band-shaped body of the third base fabric is 50 cm to 500 cm.

(11) The papermaking felt according to (9) or (10), wherein width dimensions of the band-shaped body of the first base fabric, the band-shaped body of the second base fabric, and the band-shaped body of the third base fabric are the same.

(12) The papermaking felt according to any one of (9) to (11), wherein the band-shaped body of the first base fabric, the band-shaped body of the second base fabric, and the band-shaped body of the third base fabric are of the same material.

(13) The papermaking felt according to any one of (9) to (12), wherein the band-shaped body of the third base fabric is a woven fabric.

(14) The papermaking felt according to any one of (9) to (13), wherein the band-shaped body of the first base fabric, the band-shaped body of the second base fabric, and the band-shaped body of the third base fabric are the same woven fabric.

(15) The papermaking felt according to any one of (1) to (8), wherein the third base fabric is a base fabric having a plurality of ground warp yarns and a plurality of ground weft yarns and formed such that a length of the ground weft yarn determines a width dimension of the papermaking felt.

(16) The papermaking felt according to any one of (1) to (15), wherein the third base fabric is placed between the first base fabric and the second base fabric.

(17) The papermaking felt according to any one of (1) to (15), wherein the third base fabric is placed in an uppermost portion of the base fabric.

(18) The papermaking felt according to any one of (1) to (15), wherein the third base fabric is placed in a lowermost portion of the base fabric.

(19) The papermaking felt according to any one of (1) to (15), including a base fabric and at least one batt layer integrated with the base fabric, wherein the base fabric comprises the first base fabric, the second base fabric, the third base fabric, and a fourth base fabric, the first base fabric, the second base fabric, the third base fabric, and the fourth base fabric are laminated together in an arbitrary order, and the fourth base fabric is a base fabric having at least a plurality of ground warp yarns parallel to the machine direction of the papermaking felt or a plurality of ground weft yarns parallel to a cross-machine direction of the papermaking felt.

By the above configuration, the warp yarns parallel to the machine direction of the papermaking felt of the third base fabric make up for the strength in the machine direction of the papermaking felt and the base fabric layer of the present invention, and thereby the force, by which the warp yarn of the base fabric formed by spirally winding a band-shaped body having a width smaller than the width of the papermaking felt tends to be parallel to the machine direction, is countered; thus, a base fabric of a papermaking felt and a papermaking felt, in which wrinkling and deviation do not occur during the production of the base fabric or the felt or during the use of the felt, can be provided.

DETAILED DESCRIPTION OF THE EMBODIMENT(S)

Figure 1:
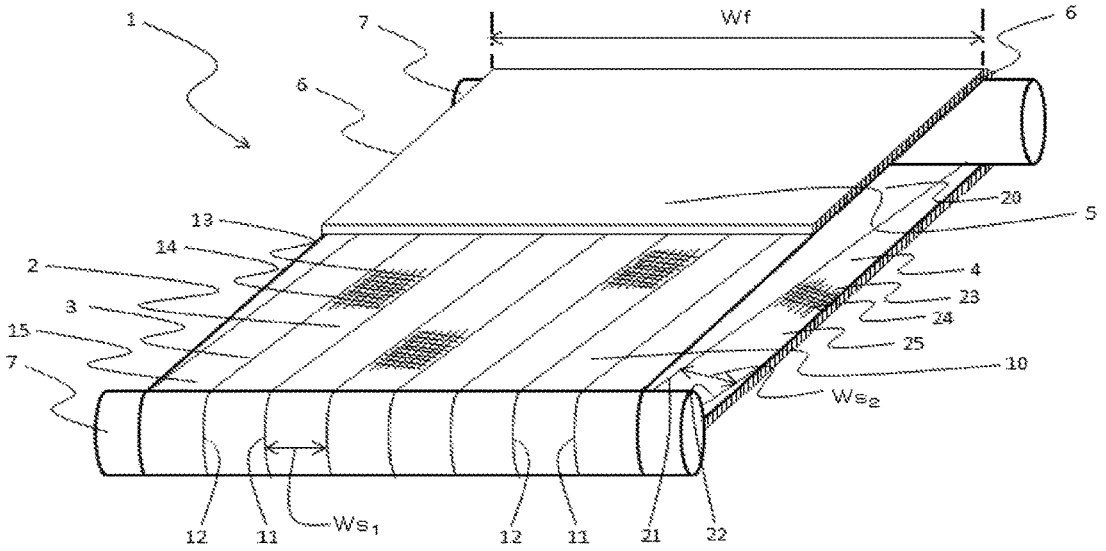
FIG. 1 is a perspective view showing an example of the papermaking felt of an embodiment of the present invention.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

Although embodiments of the present invention are described in detail with reference to the drawings, the present invention is not limited to these.

Unless otherwise defined in the present specification, all the technical terms and scientific terms used in the present specification have the same meanings as those a person skilled in the art understands usually. All the patents, applications, and other publications (including information available from the Internet) referred to in the present specification are incorporated in the present specification by reference.

FIG. 1 is a perspective view showing an example of the papermaking felt according to an embodiment of the present invention. A felt 1 shown in the drawing is a papermaking felt in which a base fabric 2 of felt, in which a first base fabric 10, a second base fabric 20, and a third base fabric 30 (not shown) are laminated together such that the first base fabric 10 is placed in the uppermost portion of the base fabric (the wet paper web surface side 3), the second base fabric 20 is placed in the lowermost portion of the base fabric (the roll surface side 4), and the third base fabric 30 is placed between the first base fabric 10 and the second base fabric 20, and a batt layer 5 are integrated. The felt 1 does not comprise any seam loop. Thus, a degree of difficulty in production of the felt 1 can be reduced and the time of seam loop formation can be omitted to reduce the production cost. On the other hand, by virtue of the base fabric 2 comprising the first base fabric 10, the second base fabric 20, and the third base fabric 30, in the felt 1, wrinkling and deviation do not occur during the production of the base fabric 2 or the felt 1 or during the use of the felt 1 as described below in detail.

In FIG. 1, parts of a plurality of ground warp yarns 13 and 23, a plurality of ground weft yarns 14 and 24, and the batt layer 5 are omitted for ease of understanding. The batt layer 5 is, in practice, uniformly placed at least on the entire surface on the wet paper web surface side 3 of the base fabric 2.

Figure 2:
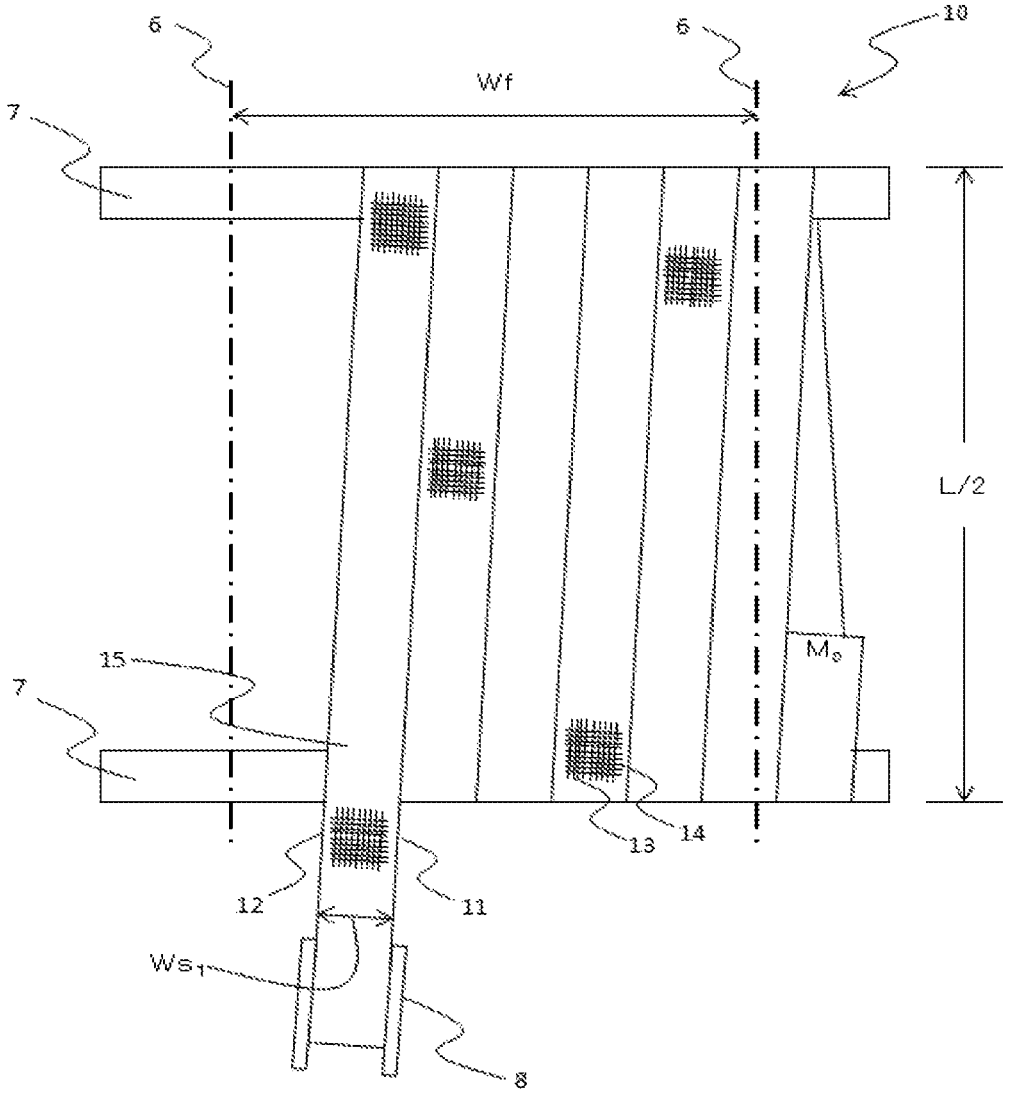
FIG. 2 is a top view showing an example of a part of the base fabric of the papermaking felt of an embodiment of the present invention and a method for producing the same.

FIG. 2 is a top view showing an example of the first base fabric 10, which is a part of the base fabric 2 of the papermaking felt according to an embodiment of the present invention, and a method for producing the same. As shown in FIG. 2, the first base fabric 10 is formed by spirally winding a band-shaped body 15 having a width $Ws_1$ smaller than the width Wf of the papermaking felt and having a plurality of ground warp yarns 13, a plurality of ground weft yarns 14, a first side edge 11, and a second side edge 12 in such a manner that the first side edge 11 and the second side edge 12 are adjacent and thereby joining the side edges together.

The first base fabric 10 is formed by, while rotating rolls 7 and a stock roll 8 of the band-shaped body, performing spiral winding around the two parallel arranged rolls (the rolls that determine the felt length dimension L), with an end $M_0$ of the band-shaped body 15 as a starting point, in such a manner that the first side edge 11 and the second side edge 12 of the band-shaped body 15 are adjacent and joining the side edges together until the width Wf of the felt is ensured. At this time, the stock roll 8 moves left in accordance with the conditions of fabrication of the first base fabric 10.

The first base fabric 10 illustrated in FIG. 2 is a base fabric formed by spirally winding the band-shaped body 15 right-handed; the right-handed winding herein refers to, when the rolls 7 and the stock roll 8 are viewed from the side of the start of winding of the band-shaped body, a direction in which the first base fabric 10 is formed by rotating the rolls 7 and the stock roll 8 right-handed.

The method for joining the side edges of adjacent parts of the band-shaped body 15 together is not particularly limited; the side edges of adjacent parts of the band-shaped body 15 can be joined together using sewing together with a sewing machine, melting, fusion adhesion, etc. The side edges are preferably made adjacent and joined together to such a degree that there is no gap. The side edges may overlap approximately several millimeters; in the present specification, also the case where the side edges overlap approximately several millimeters is included in the concept of being made adjacent.

The second base fabric 20, which is a part of the base fabric 2 of the papermaking felt according to an embodiment of the present invention, is formed by spirally winding a band-shaped body 25 having a width $Ws_2$ smaller than the width Wf of the papermaking felt and having a plurality of ground warp yarns 23, a plurality of ground weft yarns 24, a first side edge 21, and a second side edge 22 in such a manner that the first side edge 21 and the second side edge 22 are adjacent and thereby joining the side edges together.

Also the second base fabric 20 can be produced in a similar manner to the first base fabric 10. That is, similarly to the first base fabric 10 illustrated in FIG. 2, the second base fabric 20 is formed by, while rotating the rolls 7 and the stock roll 8 of the band-shaped body, performing spiral winding around the two parallel arranged rolls (the rolls that determine the felt length dimension L), with an end $M_0$ of the band-shaped body 25 as a starting point, in such a manner that the first side edge 21 and the second side edge 22 of the band-shaped body 25 are adjacent and joining the side edges together until the width Wf of the felt is ensured (not shown). At this time, the stock roll 8 moves left in accordance with the conditions of fabrication of the second base fabric 20. The winding direction of the second base fabric 20 of the base fabric 2 of the papermaking felt 1 of an embodiment of the present invention is set opposite to the winding direction of the first base fabric 10; thus, in this case, the second base fabric 20 is inverted.

The second base fabric 20 may be formed also by, while rotating the rolls 7 and the stock roll 8 of the band-shaped body, performing winding while placing the end $M_0$ of the band-shaped body 25 of the second base fabric 20 on the left side of the two parallel arranged rolls (the rolls that determine the felt length dimension L) (placing left-right symmetric to FIG. 2) in such a manner that the first side edge 21 and the second side edge 22 of the band-shaped body 25 are adjacent and joining the side edges together until the width Wf of the felt is ensured (not shown). At this time, the stock roll 8 moves right in accordance with the conditions of fabrication of the second base fabric 20. The second base fabric 20 thus obtained is different in winding direction from the first base fabric 10; thus, in this case, there is no need to invert the second base fabric 20.

It is self-evident that a certain angle determined by the width $Ws_1$ of the band-shaped body and the felt length dimension L is provided between the direction of the ground warp yarn 13 of the band-shaped body 15 of the first base fabric 10 and the direction of the felt length dimension parallel to the machine direction (MD), and similarly a certain angle determined by the width $Ws_2$ of the band-shaped body and the felt length dimension L is provided between the direction of the ground warp yarn 23 of the second base fabric 20 of the band-shaped body 25 and the direction of the felt length dimension parallel to the machine direction (MD), as a matter of course. The dimensions of the widths $Ws_1$ and $Ws_2$ of the band-shaped bodies are preferably set to 50 cm to 150 cm. If the width is too small, the number of times of winding to ensure the width Wf of the papermaking felt is increased and it takes time and effort; if the width is too large, the angle between the ground warp yarn of the band-shaped body and the machine direction (the MID direction) is increased and the force by which the ground warp yarn of the band-shaped body tends to be parallel to the machine direction (the MD direction) acts more, and the problem of wrinkling becomes larger. The width dimensions of the band-shaped body 15 and 25 may also be same.

As the material of the ground warp yarns 13 and 23 and the ground weft yarns 14 and 24 of the band-shaped bodies 15 and 25 and the batt layer 5, polyesters (polyethylene terephthalate, polybutylene terephthalate, and the like), aliphatic polyamides (polyamide 6, polyamide 66, polyamide 11, polyamide 12, polyamide 612, and the like), an aromatic polyamide (an aramid), polyvinylidene fluoride, polypropylene, a polyetheretherketone, polytetrafluoroethylene, polyethylene, wool, cotton, a metal, etc. may be used. As the ground warp yarns 13 and 23 and the ground weft yarns 14 and 24, a monofilament single yarn, a monofilament twisted yarn, a multifilament single yarn, or a multifilament twisted yarn of the material mentioned above may be used. The form such as the fineness and the length of the ground warp yarns 13 and 23, the ground weft yarns 14 and 24, and the batt layer 5 is not particularly limited, and may be selected as appropriate in accordance with the design. The materials of the band-shaped bodies 15 and 25 may be different or same. When the materials of the band-shaped bodies 15 and 25 are same, an operation for providing different band-shaped bodies can be omitted.

The form of the band-shaped bodies 15 and 25 may be a woven fabric using the material mentioned above, but is not limited to woven fabrics, and a lattice-like material in which ground warp yarns and ground weft yarns are arranged vertically may be used. The band-shaped bodies 15 and 25 may be the same woven fabric. This allows an operation for providing different band-shaped bodies to be omitted.

Figure 3:
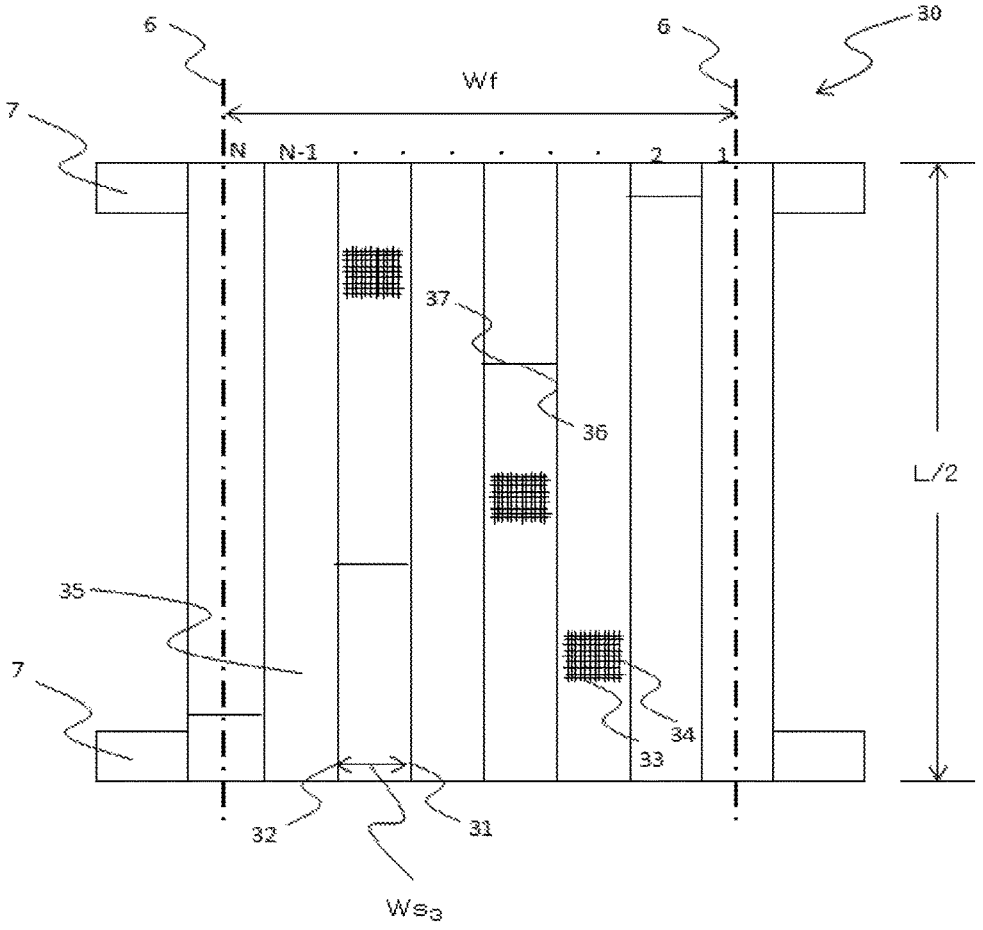
FIG. 3 is a top view showing an example of another part of the base fabric of the papermaking felt of an embodiment of the present invention and a method for producing the same.

FIG. 3 is a top view showing an example of the third base fabric 30, which is a part of the base fabric 2 of the papermaking felt according to an embodiment of the present invention, and a method for producing the same. As shown in FIG. 3, the third base fabric 30 is formed by arranging, in CMD, N or more (in FIG. 3, N=8) annular band-shaped bodies each of which is obtained by joining the end edges of a band-shaped body 35 having a width $Ws_3$ smaller than the width Wf of the papermaking felt and having a plurality of ground warp yarns 33, a plurality of ground weft yarns 34, a first end edge 36, a second end edge 37, a first side edge 31, and a second side edge 32 in such a manner that the first end edge 36 and the second end edge 37 are adjacent and joining the side edges in such a manner that the second side edge 32 of the N−1-th annular band-shaped body and the first side edge 31 of the N-th annular band-shaped body are adjacent.

The method for joining the side edges of adjacent ones of the band-shaped bodies 35 together and the method for joining the first end edge and the second end edge of each band-shaped body 35 together are not particularly limited; the side edges of adjacent ones of the band-shaped bodies 35 can be joined together using sewing together with a sewing machine, melting, fusion adhesion, etc., and the end edges can be joined using the same mechanism as that for the side edges, sewing together, or etc. The side edges and the end edges are preferably made adjacent and joined together to such a degree that there is no gap. The side edges may overlap approximately several millimeters; in the present specification, also the case where the side edges overlap approximately several millimeters is included in the concept of being made adjacent. The positional relationship between the end edges of adjacent ones of the band-shaped bodies 35 is not particularly limited, but they are preferably arranged scatteredly, i.e. each adjacent end edges is arranged at a different position in MD, in terms of ensuring the strength in MD of the third base fabric 30. Although in FIG. 3 the first end edge and the second end edge are joined together so as to be parallel to CMD, they may be joined together so as to have an angle with respect to CMD. Thereby, the joint portion does not enter the pressured portion at once, but enters little by little; thus, the occurrence of vibration can be prevented.

The width $Ws_3$ of the band-shaped body 35 is not particularly limited; however, if the width is too small, the number of annular band-shaped bodies needed to ensure the width Wf of the papermaking felt is increased and it takes time and effort; on the other hand, if the width is large, the time and effort can be omitted. Therefore, for the purpose of omitting the time and effort, the third base fabric 30 may be formed by joining or sewing both end edges together while setting the dimension of the width $Ws_3$ of the band-shaped body 35 to the width Wf of the papermaking felt. Alternatively, from the viewpoint of the productivity of band-shaped bodies, the width $Ws_3$ of the band-shaped body may be set equal to the width $Ws_1$ of the band-shaped body and the width $Ws_2$ of the band-shaped body. Specifically, the width $Ws_3$ of the band-shaped body 35 may be for example set to 50 cm to 500 cm, preferably 50 cm to 150 cm.

FIG. 3 shows, as an example of the third base fabric 30 of the base fabric 2 of the papermaking felt according to an embodiment of the present invention, a base fabric formed by arranging, in CMD, annular band-shaped bodies each of which is obtained by joining together the end edges of a band-shaped body having a width $Ws_3$ smaller than the width Wf of the papermaking felt and having a plurality of ground warp yarns 33, a plurality of ground weft yarns 34, a first end edge 36, a second end edge 37, a first side edge 31, and a second side edge 32 and joining the side edges of adjacent ones of the annular band-shaped bodies together; but the third base fabric is not limited to this, and the third base fabric 30 may be woven also by hollow weaving while setting the width $Ws_3$ of the band-shaped body 35 to the width Wf of the papermaking felt, for example. In this case, a length of the ground weft yarn 34 of the band-shaped body 35 determines a width dimension of the papermaking felt 1.

As the material of the ground warp yarn 33 and the ground weft yarn 34 of the band-shaped body 35, any material that can be used in the band-shaped bodies 15 and 25 is possible, and the same material as the band-shaped body 15 or the band-shaped body 25 may be used. The form of the band-shaped body 35 may be a woven fabric using the material mentioned above, but is not limited to woven fabrics, and a lattice-like material in which ground warp yarns and ground weft yarns are arranged vertically may be used. Further, the third base fabric 30 may be a fabric in which a yarn row composed only of warp yarns is fixed with a molten film or molten fibers.

The band-shaped body 35 may, for example, be the same woven fabric as the band-shaped bodies 15 and 25. In this case, a preparation of other woven fabric for the band-shaped body 35 can be omitted. Further, the strength in the warp direction of the third base fabric 30, which is below described, can easily be ensured.

In the present embodiment, of the third base fabric 30 are placed parallel to the machine direction of the papermaking felt 1. This makes up for the strength in the machine direction of the papermaking felt 1 and the base fabric 2. Thus, the ground warp yarns 33 counters to a force by the act of the ground warp yarns 13 and 23 of the band-shaped bodies 15 and 25 to tend to be parallel to the machine direction of the papermaking felt 1, and wrinkling and deviation of the base fabric 2 and the papermaking felt 1 can be prevented.

The strength in the warp direction of the third base fabric 30 is preferably 10% or more of the strength in the warp direction of the first base fabric 10 or the second base fabric 20. This allows the strength in the machine direction of the papermaking felt 1 and the base fabric 2 to more surely be made up, and wrinkling and deviation of the base fabric 2 and the papermaking felt 1 can more surely be prevented. The strength in the warp direction of the third base fabric 30 is preferably 30% or more, more preferably 50% or more, furthermore preferably 100% or more of the strength in the warp direction of the first base fabric 10 or the second base fabric 20. The upper limit is not particularly limited; in view of obtaining the material, however, it may be 200% or less, preferably 170% or less of the strength in the warp direction of the first base fabric 10 or the second base fabric 20.

Here, the "strength" of a base fabric means its breaking strength. The strength of the base fabric can be determined for example by obtaining a base fabric sample with a dimension of 30 cm in a warp yarn direction and 5 cm of a weft yarn direction from each base fabric, grabbing its two end portion in the warp yarn direction by a test machine, and pulling in the warp yarn direction by 200 mm/min FIG. 1 describes, as an example of the papermaking felt according to an embodiment of the present invention, a papermaking felt in which the base fabric 2 of felt in which the first base fabric 10, the second base fabric 20, and the third base fabric 30 (not shown) are laminated together such that the first base fabric 10 is placed in the uppermost portion of the base fabric (the wet paper web surface side 3), the second base fabric 20 is placed in the lowermost portion of the base fabric (the roll surface side 4), and the third base fabric 30 is placed between the first base fabric 10 and the second base fabric 20, and the batt layer 5 are integrated; but the present invention is not limited to this, and the first base fabric 10, the second base fabric 20, and the third base fabric 30 may be arranged in an arbitrary order. Specifically an embodiment, in which the third base fabric is placed in an uppermost portion of the base fabric, and an embodiment, in which the third base fabric is placed in a lowermost portion of the base fabric, can be exemplified. At this time, depending on the design of each base fabric, in general these base fabrics are finely laminated together and arranged by setting the length dimension of the base fabric to slightly increase with transition from the roll surface side toward the wet paper web surface side.

A desired papermaking felt 1 can be obtained by integrating the batt layer 5 with the base fabric 2 obtained by arranging the first base fabric 10, the second base fabric 20, and the third base fabric 30 in an arbitrary order and performing cutting with the felt width dimension Wf parallel to the felt running direction. Although the cutting with the felt width dimension Wf may be performed on each of the first base fabric 10, the second base fabric 20 and the third base fabric 30, usually in this case, in view of the dimension change in a post-process, a width larger than the felt width dimension Wf is ensured for the width dimension of each base fabric layer and cutting is performed with the desired felt width dimension Wf in the final process.

The mass per unit area of the felt 1 is not particularly limited, but the felt 1 is usually produced with 500 g/m$^2$ to 2000 g/m$^2$, and the mass per unit area is selected as appropriate in accordance with the grade of the paper to be produced by papermaking and the part where the felt is used in the papermaking machine. The thickness of the felt 1 is not particularly limited, but the felt 1 is usually produced with 1.5 mm to 5.0 mm in accordance with mainly the mass per unit area.

As another embodiment of the present invention, the base fabric 2 may be configured by further adding a fourth base fabric to the base fabric 2 composed of the first base fabric, the second base fabric, and the third base fabric shown in FIG. 1. The first base fabric to the fourth base fabric are laminated together in an arbitrary order, The fourth base fabric may comprise a plurality of ground warp yarns parallel to the machine direction of the papermaking felt or a plurality of ground weft yarns parallel to the cross-machine direction of the papermaking felt.

The form of the fourth base fabric may be a woven fabric made of a material that can be used in the first base fabric and the second base fabric, but is not limited to woven fabrics, and a lattice-like material in which ground warp yarns and ground weft yarns are arranged vertically or a fabric in which a yarn row composed only of warp yarns or weft yarns is fixed with a molten film or molten fibers may be used.

EXAMPLE

<Band-shaped Body 1>

Warp yarn: a monofilament single yarn made of polyamide 6 with 1200 dtex

Weft yarn: a monofilament single yarn made of polyamide 6 with 1200 dtex

Structure: 40 warp yarns/5 cm, 40 weft yarns/5 cm, a 1/1 plain structure, the width of the band-shaped body: 100 cm <Band-shaped Body 2>

Warp yarn: monofilament twisted yarn of three twisted filaments, in which two monofilament single yarns made of polyamide 6 with 330 dtex are twisted Weft yarn: a monofilament single yarn made of polyamide 6 with 1000 dtex Structure: 40 warp yarns/5 cm, 40 weft yarns/5 cm, a 2/2 twill structure, the width of the band-shaped body: 100 cm <Base Fabric 1>

While the band-shaped body 1 mentioned above was spirally wound right-handed such that the felt length dimension was 15.0 m, the first side edge and the second side edge were sewn together with a sewing machine. The width dimension of the base fabric 1 was set to 650 cm (the felt width dimension was set to 520 cm).

<Base Fabric 2>

While the band-shaped body 1 mentioned above was spirally wound left-handed such that the felt length dimension was 15.0 m, the first side edge and the second side edge were sewn together with a sewing machine. The width dimension of the base fabric 2 was set to 650 cm (the felt width dimension was set to 520 cm).

<Base Fabric 3>

Annular band-shaped bodies each of which was obtained by performing cutting so that the length of the band-shaped body 1 mentioned above was 15.0 m (the felt length dimension was 15.0 m) and joining the first end edge and the second end edge together were prepared, seven of the annular band-shaped bodies were arranged in CMD, and the side edges of adjacent annular band-shaped bodies were sewn together with a sewing machine. After that, 25 cm of each of both end portions in the width direction of the base fabric 3 was cut, and thereby the width dimension of the base fabric 3 was set to 650 cm (the felt width dimension was set to 520 cm).

<Base Fabric 4>

While the band-shaped body 2 mentioned above was spirally wound right-handed such that the felt length dimension was 15.0 m, the first side edge and the second side edge were sewn together with a sewing machine. The width dimension of the base fabric 4 was set to 650 cm (the felt width dimension was set to 520 cm).

<Base Fabric 5>

While the band-shaped body 2 mentioned above was spirally wound left-handed such that the felt length dimension was 15.0 m, the first side edge and the second side edge were sewn together with a sewing machine. The width dimension of the base fabric 5 was set to 650 cm (the felt width dimension was set to 520 cm).

<Base Fabric 6>

Warp yarn: a monofilament single yarn made of polyamide 6 with 550 dtex

Weft yarn: a monofilament single yarn made of polyamide 6 with 500 dtex

Structure: 60 warp yarns/5 cm, 42 weft yarns/5 cm, a 1/1 plain structure

The base fabric 6 was prepared by hollow weaving such that the felt length dimension was 15.0 m and the width dimension was 650 cm (the felt width dimension was 520 cm).

<Base Fabric 7>

Warp yarn: monofilament twisted yarn of two twisted filaments, in which two monofilament single yarns made of polyamide 6 with 330 dtex are twisted Weft yarn: monofilament twisted yarn in which three monofilament single yarns made of polyamide 6 with 330 dtex are twisted Structure: 36 warp yarns/5 cm, 40 weft yarns/5 cm, a 1/1 plain structure The base fabric 7 was prepared by hollow weaving such that the felt length dimension was 15.0 m and the width dimension was 650 cm (the felt width dimension was 520 cm).

The base fabrics of Examples 1 to 4 and Comparative Examples 1 and 2 were prepared in the following manner using the base fabrics 1 to 7 mentioned above.

<Base Fabric of Example 1>

The base fabric 1, the base fabric 3, and the base fabric 2 were laminated together and arranged in this order from the wet paper web surface side, and thus a base fabric of a three-layer structure was prepared.

<Base Fabric of Example 2>

The base fabric 6, the base fabric 1, and the base fabric 2 were laminated together and arranged in this order from the wet paper web surface side, and thus a base fabric of a three-layer structure was prepared.

<Base Fabric of Example 3>

The base fabric 6, the base fabric 4, and the base fabric 5 were laminated together and arranged in this order from the wet paper web surface side, and thus a base fabric of a three-layer structure was prepared.

<Base Fabric of Example 4>

The base fabric 7, the base fabric 1, and the base fabric 2 were laminated together and arranged in this order from the wet paper web surface side, and thus a base fabric of a three-layer structure was prepared.

<Base Fabric of Comparative Example 1>

The base fabric 1 and the base fabric 2 were laminated together and arranged in this order from the wet paper web surface side, and thus a base fabric of a two-layer structure was prepared.

<Base Fabric of Comparative Example 2>

The base fabric 1, the base fabric 2, and the base fabric 2 were laminated together and arranged in this order from the wet paper web surface side, and thus a base fabric of a three-layer structure was prepared.

For the base fabrics of Examples 1 to 4 and Comparative Examples 1 and 2, a 500 g/m$^2$ short fiber batt of polyamide 6 with a fineness of 11 dtex was entangled and integrated by needling with the wet paper web-side surface of each base fabric, and a 200 g/m$^2$ short fiber batt of polyamide 6 with a fineness of 13 dtex was entangled and integrated by needling with the roll surface side; the processes of drying and curing were performed; and finally cutting was performed with the felt width dimension of 520 cm.

Here, in the base fabric 3, the base fabric 6 and the base fabric 7, warp yarns were placed parallel to the machine direction. In Example 1, the strength in the warp direction of the base fabric 3 was 100% of the strength in the warp direction of the base fabrics 1 and 2, since the base fabric 3 is composed of the same band-shaped body as of the base fabrics 1 and 2. Also, in Example 2, the strength in the warp direction of the base fabric 6 was 50.0% of the strength in the warp direction of the base fabrics 1 and 2. Further, in Example 3, the strength in the warp direction of the base fabric 6 was 14.5% of the strength in the warp direction of the base fabrics 4 and 5. Further, in Example 4, the strength in the warp direction of the base fabric 7 was 169% of the strength in the warp direction of the base fabrics 1 and 2.

For Examples 1, 2, 3 and 4, a problem during production did not occur. However, for Comparative Example 1, the felt slightly waved during felt curing, and high tension was not able to be applied; consequently, the length dimension of the felt was not able to be ensured. Furthermore, in this case, it is highly likely that wrinkling will occur during felt curing, depending on the design. In Comparative Example 2, wrinkling occurred during felt curing, and the use as a papermaking felt was impossible.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

REFERENCE SIGNS LIST $M_0$: end of band-shaped body in length direction, L: length dimension of papermaking felt, Wf: width of papermaking felt, $W_{S1}$: width of band-shaped body of first base fabric, $W_{S2}$: width of band-shaped body of second base fabric, $W_{S3}$: width of band-shaped body of third base fabric, 1: papermaking felt, 2: base fabric, 3: wet paper web surface side, 4: roll surface side, 5: batt layer, 6: end of papermaking felt in width direction, 7: roll, 8: stock roll of band-shaped body, 10: first base fabric, 11: first side edge of band-shaped body of first base fabric, 12: second side edge of band-shaped body of first base fabric, 13: ground warp yarns of band-shaped body of first base fabric, 14: ground weft yarns of band-shaped body of first base fabric, 15: band-shaped body of first base fabric, 20: second base fabric, 21: first side edge of band-shaped body of second base fabric, 22: second side edge of band-shaped body of second base fabric, 23: ground warp yarns of band-shaped body of second base fabric, 24: ground weft yarns of band-shaped body of second base fabric, 25: band-shaped body of second base fabric, 30: third base fabric, 31: first side edge of band-shaped body of third base fabric, 32: second side edge of band-shaped body of third base fabric, 33: ground warp yarns of band-shaped body of third base fabric, 34: ground weft yarns of band-shaped body of third base fabric, 35: band-shaped body of third base fabric, 36: first end edge of band-shaped body of third base fabric, 37: second end edge of band-shaped body of third base fabric

What is claimed is:

1. A papermaking felt comprising:

at least one base fabric and at least one batt layer integrated with the base fabric, wherein the base fabric comprises a first base fabric, a second base fabric, and a third base fabric, the first base fabric, the second base fabric, and the third base fabric are laminated together in an arbitrary order, the first base fabric is a base fabric formed by spirally winding, in a right-handed manner, a band-shaped body having a width smaller than a width of the papermaking felt and having a plurality of ground warp yarns, a plurality of ground weft yarns, a first side edge parallel to a ground warp direction, and a second side edge parallel to the ground warp direction in such a manner that the first side edge and the second side edge are adjacent and thereby joining the side edges together, the second base fabric is a base fabric formed by spirally winding, in a left-handed manner, a band-shaped body having a width smaller than the width of the papermaking felt and having a plurality of ground warp yarns, a plurality of ground weft yarns, a first side edge parallel to a ground warp direction, and a second side edge parallel to the ground warp direction in such a manner that the first side edge and the second side edge are adjacent and thereby joining the side edges together, the third base fabric is a base fabric having at least a plurality of ground warp yarns parallel to an machine direction of the papermaking felt, wherein the third base fabric includes an arrangement, in a cross-machine direction, of N or more (N≥2) annular band-shaped bodies, each of N or more annular band shaped bodies includes end edges of a band-shaped body that are joined together and that have a width smaller than the width of the papermaking felt and have a plurality of ground warp yarns, a plurality of ground weft yarns, a first end edge parallel to a ground weft direction, a second end edge parallel to the ground weft direction, a first side edge parallel to a ground warp direction, and a second side edge parallel to the ground warp direction, in such a manner that the first end edge of an N-th annular band shaped body and the second end edge of an N−1-th annular band shaped body are adjacent, and the second side edge of an N−1-th annular band-shaped body and the first side edge of an N-th annular band-shaped body are joined together in such a manner that both side edges are adjacent, wherein each first end edge of the N-th annular band shaped body and adjacent second end edge of the N−1-th annular band shaped body form a pair of end edges, and wherein each pair of end edges is located at a different position in the machine direction.

2. The papermaking felt according to claim 1, wherein strength in a warp direction of the third base fabric is 10% or more of strength in a warp direction of the first base fabric or a strength in a warp direction of the second base fabric.

3. The papermaking felt according to claim 1, wherein strength in the warp direction of the third base fabric is 50% or more of the strength in the warp direction of the first base fabric or the strength in the warp direction of the second base fabric.

4. The papermaking felt according to claim 1, wherein strength in the warp direction of the third base fabric is 100% or more of the strength in the warp direction of the first base fabric or the strength in the warp direction of the second base fabric.

5. The papermaking felt according to claim 1, wherein width dimensions of the band-shaped body of the first base fabric and the band-shaped body of the second base fabric are 50 cm to 150 cm.

6. The papermaking felt according to claim 1, wherein width dimensions of the band-shaped body of the first base fabric and the band-shaped body of the second base fabric are the same.

7. The papermaking felt according to claim 1, wherein the band-shaped body of the first base fabric and the band-shaped body of the second base fabric are of the same material.

8. The papermaking felt according to claim 1 wherein the band-shaped body of the first base fabric and the band-shaped body of the second base fabric are the same woven fabric.

9. The papermaking felt according to claim 1, wherein a width dimension of the band-shaped body of the third base fabric is 50 cm to 500 cm.

10. The papermaking felt according to claim 1, wherein width dimensions of the band-shaped body of the first base fabric, the band-shaped body of the second base fabric, and the band-shaped body of the third base fabric are the same.

11. The papermaking felt according to claim 1, wherein the band-shaped body of the first base fabric, the band-shaped body of the second base fabric, and the band-shaped body of the third base fabric are of the same material.

12. The papermaking felt according to claim 1, wherein the band-shaped body of the third base fabric is a woven fabric.

13. The papermaking felt according to claim 1, wherein the band-shaped body of the first base fabric, the band-shaped body of the second base fabric, and the band-shaped body of the third base fabric are the same woven fabric.

14. The papermaking felt according to claim 1, wherein the third base fabric is placed between the first base fabric and the second base fabric.

15. The papermaking felt according to claim 1, wherein the third base fabric is placed in an uppermost portion of the base fabric.

16. The papermaking felt according to claim 1, wherein the third base fabric is placed in a lowermost portion of the base fabric.

17. The papermaking felt according to claim 1, comprising a base fabric and at least one batt layer integrated with the base fabric, wherein the base fabric comprises the first base fabric, the second base fabric, the third base fabric, and a fourth base fabric, the first base fabric, the second base fabric, the third base fabric, and the fourth base fabric are laminated together in an arbitrary order, and the fourth base fabric is a base fabric having at least a plurality of ground warp yarns parallel to the machine direction of the papermaking felt or a plurality of ground weft yarns parallel to a cross-machine direction of the papermaking felt.

18. The papermaking felt according to claim 1, wherein strength in a warp direction of the third base fabric is 30% or more of strength in a warp direction of the first base fabric or a strength in a warp direction of the second base fabric.

19. A papermaking felt comprising:

at least one base fabric and at least one batt layer integrated with the base fabric, wherein the base fabric comprises a first base fabric, a second base fabric, and a third base fabric, the first base fabric, the second base fabric, and the third base fabric are laminated together in an arbitrary order, the first base fabric is a base fabric formed by spirally winding, in a right-handed manner, a band-shaped body having a width smaller than a width of the papermaking felt and having a plurality of ground warp yarns, a plurality of ground weft yarns, a first side edge parallel to a ground warp direction, and a second side edge parallel to the ground warp direction in such a manner that the first side edge and the second side edge are adjacent and thereby joining the side edges together, the second base fabric is a base fabric formed by spirally winding, in a left-handed manner, a band-shaped body having a width smaller than the width of the papermaking felt and having a plurality of ground warp yarns, a plurality of ground weft yarns, a first side edge parallel to a ground warp direction, and a second side edge parallel to the ground warp direction in such a manner that the first side edge and the second side edge are adjacent and thereby joining the side edges together, the third base fabric is a base fabric having at least a plurality of ground warp yarns parallel to an machine direction of the papermaking felt, wherein the third base fabric is a base fabric having a plurality of ground warp yarns and a plurality of ground weft yarns and formed such that a length of the ground weft yarn is equal to a total width dimension of the papermaking felt.

* * * * *